US006200185B1

(12) United States Patent
Kuster, Jr.

(10) Patent No.: US 6,200,185 B1
(45) Date of Patent: Mar. 13, 2001

(54) FLYING DISC TOY WITH DISPLAYING PANEL

(76) Inventor: Dwight Trump Kuster, Jr., 7116 Wilton Dr., NE., Cedar Rapids, IA (US) 52402

( * ) Notice: Subject to any disclaimer, the term of this patent is extended or adjusted under 35 U.S.C. 154(b) by 0 days.

(21) Appl. No.: 09/360,513

(22) Filed: Jul. 26, 1999

(51) Int. Cl.[7] ..... A63H 27/00
(52) U.S. Cl. ..... 446/47; 446/46
(58) Field of Search ..... 446/46, 901, 234, 446/47, 48, 66; 40/212, 214, 215

(56) References Cited

U.S. PATENT DOCUMENTS 2,949,094 * 8/1960 Clothier ..... 40/215
4,209,936 * 7/1980 Sklar ..... 446/46
5,324,223 * 6/1994 Yang ..... 446/46
5,520,565 * 5/1996 Ulysse ..... 446/46
5,738,526 * 4/1998 Cerda et al. ..... 434/304

* cited by examiner

*Primary Examiner*—Sam Rimell
(74) *Attorney, Agent, or Firm*—Simmons, Perrine, Albright & Ellwood PLC

(57) ABSTRACT

A flying disc comprising a displaying panel and coupling means for attaching the displaying panel to the flying disc is provided. The flying disc provides suitable space for advertising.

5 Claims, 2 Drawing Sheets

FLYING DISC TOY WITH DISPLAYING PANEL

FIELD OF THE INVENTION

The present invention is directed, in part, to a flying disk toy with a panel connected thereto. In particular, the panel is designed to provide advertising space thereon.

BACKGROUND OF THE INVENTION

Little attention has been given to providing improved advertising capabilities and characteristics for flying discs. Flying disc toys currently available on the market have been improved for flight characteristics such as, for example, by adding wings, fins, propellers, and counterbalances. Such added features, although providing desirable aerodynamic features provide little, if any, space for advertising.

U.S. Pat. No. 4,515,570 issued to Beltran discloses an attachable kit for flying discs for the purpose of providing lights and/or a counterbalance rudder for flight enhancement.

U.S. Pat. No. 5,324,223 issued to Yang discloses a fuselage with a nose-mounted propeller and a set of wings attached to the fuselage which, when mounted pivotally to a flying disc, purportedly improves overall aerodynamic lift when in flight.

U.S. Pat. No. 5,520,565 issued to Ulysse discloses a V-shaped fuselage having an adjustable tail section. The assembly, when attached rotatably to a flying disc, purportedly provides for longer flights and controlled direction.

U.S. Pat. No. 4,253,672 issued to Milzoff et al. discloses a flexible flying disc constructed of various materials which purportedly provide resiliency and are impervious to water.

U.S. Pat. No. 4,290,226 issued to Stauffer discloses a flexible flat flying disc constructed from woven fabric and a resilient rim for the purpose of retaining an original shape.

Some of the flying discs referred to above can accommodate imprinting of advertising indicia thereupon. For example, the fuselage or the top or bottom surfaces of the flying discs can be used for advertising space. Such advertising, however, is not positioned in such a manner so as to be recognized by the intended audience. Thus, there remains a long-felt need for improved flying discs with improved advertising capabilities. Accordingly, the preferred embodiments described herein fulfill these objectives.

SUMMARY OF THE INVENTION

The present invention is directed to a flying disc comprising a disc having an upper and lower surface, a displaying panel disposed perpendicularly to the disc, and coupling means for rotatably attaching the displaying panel to the upper surface of the disc. The displaying panel preferably comprises printing space for advertising. In some embodiments of the invention, the displaying panel comprises an LCD screen. The displaying panel is preferably adapted to maintain a directional orientation in flight. In other embodiments of the invention, the flying disc further comprises at least one streamer. In other embodiments of the invention, the flying disc comprises at least one additional displaying panel attached to the upper surface of the disc.

DETAILED DESCRIPTION OF PREFERRED EMBODIMENTS

The present invention is directed, in part, to a flying disc comprising a disc and displaying panel. The displaying panel preferably contains space sufficient for displaying advertising media. Thus, the present invention can be used as a toy as well as for commercial purposes.

Figure 1:
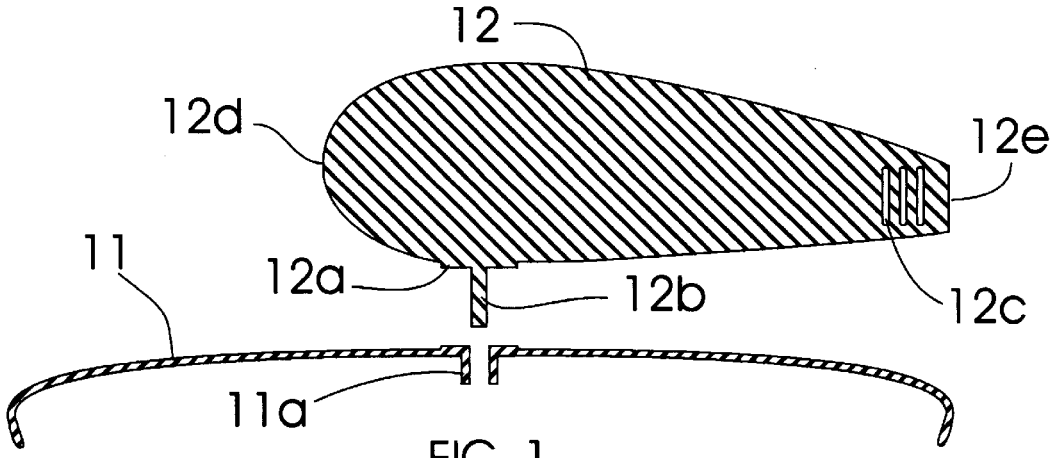
FIG. 1 depicts a vertical cross-sectional exploded view of a preferred disc and displaying panel taken on line 4—4 of FIG. 3.

Referring to FIG. 1, a disc 11 preferably has a convex upper surface and a concave lower surface. The disc preferably is from about 35 cm to about 40 cm in diameter, more preferably about 30 cm to about 35 cm in diameter, most preferably about 25 cm to about 30 cm in diameter. The disc is preferably constructed of wood, plastic, metal, or the like. The disk is preferably round, but can be oval, rectangular, teardrop or any aeronautical design known to maintain flight. One skilled in the art can modify the disc shape to any desired shape that will maintain flight.

Still referring to FIG. 1, a displaying panel 12 is shown with a leading edge 12*d* and a trailing edge 12*e*. A preferred shape for the displaying panel is shown in FIG. 1, however, any aerodynamic shape can be used. The displaying panel is preferably constructed of wood, plastic, metal, or the like.

The disc and the displaying panel are rotatably connected by a coupling means. The coupling means rotatably attaches the displaying panel to the upper surface of the disc. Any coupling means known to one skilled in the art can be used to rotatably couple the displaying panel to the disc. In preferred embodiments of the invention, the coupling means comprises a bearing 12*a* and a coupling pin 12*b* located on the displaying panel and a cylindrical pin guide 11*a* located on the disc. The bearing is preferably circular and is disposed horizontally and centrally above the coupling pin and underneath the displaying panel. The cylindrical pin guide extends downward from the concave side of the disc. It is emphasized, however, that other equivalent coupling means can be used which allows for the displaying panel to rotate relative to the disc.

Figure 2:
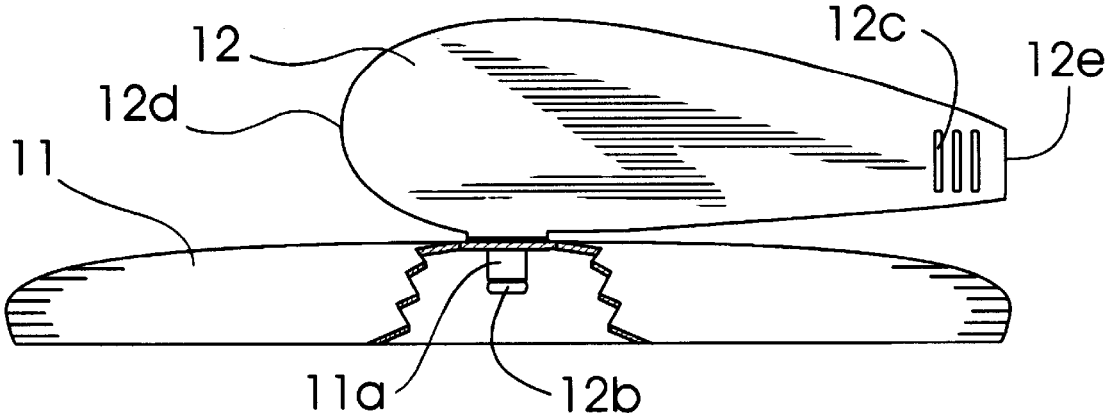
FIG. 2 depicts a cutaway side view showing an assembled preferred disc and displaying panel.

FIG. 2 shows a preferred embodiment whereby the coupling pin interacts with the cylindrical pin guide. The cylindrical pin guide receives the coupling pin that extends therethrough. Preferably, the coupling pin is swaged to prevent uncoupling of the displaying panel from the disc. In preferred embodiments of the invention, the coupling pin is located on the displaying panel closer to the leading edge than the trailing edge. The coupling pin, however, can be located in any position on the displaying panel.

Figure 3:
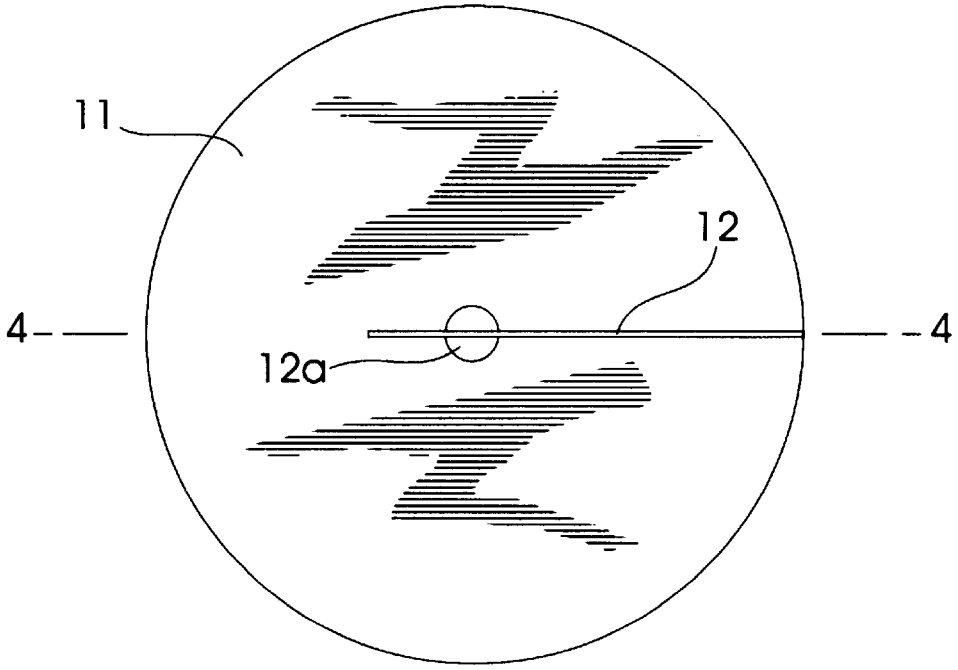
FIG. 3 shows a plan view of a preferred disc and preferred displaying panel.

In preferred embodiments of the invention, the cylindrical pin guide is located in the disc in a central location, such as shown in FIG. 3. The cylindrical pin guide, however, can be located in any position on the disc. When the displaying panel is coupled to the disc, the displaying panel rotates perpendicularly to the upper surface of the disc, as shown in FIG. 3.

In other embodiments of the invention, the displaying panel comprises an LCD screen, or an equivalent media displaying device known to those skilled in the art. The LCD can be preferably pre-programmed with the desired advertising.

Figure 4:
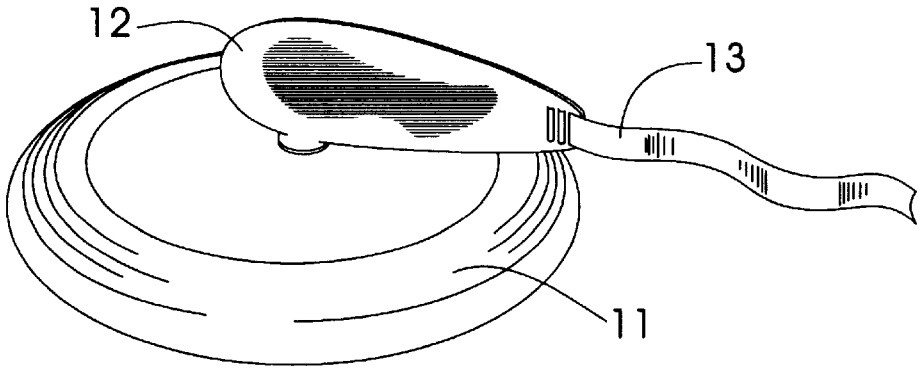
FIG. 4 shows a perspective illustration of a preferred disc, preferred displaying panel and preferred streamer.
Figure 5:
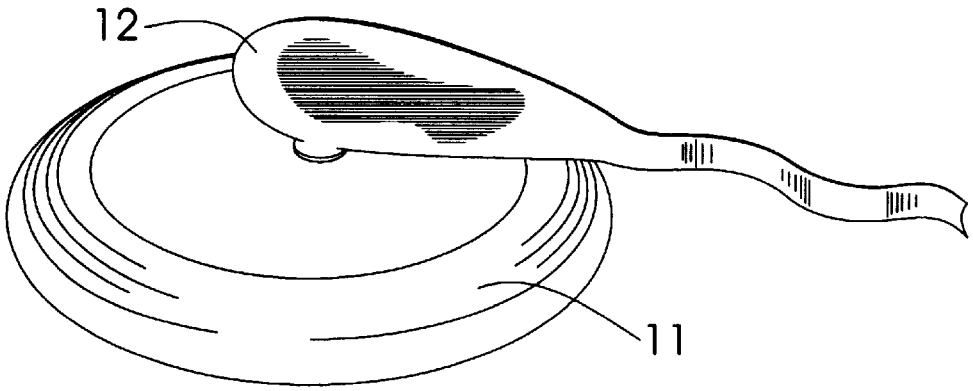
FIG. 5 depicts a perspective illustration of another preferred embodiment of the flying disc.

In other embodiments of the invention, the displaying panel comprises at least one, preferably a plurality, of slots 12*c* in the displaying panel near the trailing edge. Preferably, the slots are vertical. The slots are arranged so as to accommodate the weaving of a flexible streamer 13 therethrough, as shown in FIG. 4. The streamer is preferably ribbon-like and sized to permit at least one end to pass through slots in the displaying panel, weaving therethrough, thus affixing the streamer to the displaying panel. The streamer preferably is attached so as to be able to oscillate and undulate while the disc is in flight, whereby providing aesthetic appeal. In other embodiments of the invention, as shown in FIG. 5, the streamer and the displaying panel are merged into a single elongated displaying panel, which is substantially thinner, and more flexible at its trailing edge.

Although not limited to the present mode of operation, the flying disc, when launched forwardly and horizontally, achieves a flight comprising a spinning of the disc whose upper and lower surfaces remain substantially parallel to the ground. The displaying panel rotatably coupled to the disc is influenced by airflow thereabout, resulting in the leading edge of the displaying panel being maintained in the direction of flight. The flexible streamer, when present, trails the displaying panel during flight, and oscillates and undulates during flight.

The embodiments described above are much improved compared to currently available discs in that the present invention provides for improved and additional visible advertising space for which the flying discs are widely and commonly used. The present invention, as compared to prior art devices, provides for highly visible and recognizable advertising space, which can be seen and recognized by those using the flying disc as well as by onlookers. Because the present invention improves the visibility of advertising space while the disc is in flight, there is an instant and highly effective advantage. Since the present invention can be made of two or three parts, manufacturing is relatively easy, the costs of manufacture are minimized, and the marketability of the disc is maximized.

The preferred embodiments described herein are not meant to be limiting in any way. Various modifications of the invention, in addition to those described herein, will be apparent to those skilled in the art from the foregoing description. Such modifications are also intended to fall within the scope of the appended claims.

What is claimed is:

1. A method of display information comprising the steps of:

providing a flying disc having a disc plane and a rotating panel thereon, having a display plane which is perpendicularly disposed with respect to the disc plane;

causing information to be displayed on said rotating panel, so that it is visible along a line of sight falling within the disc plane; and, throwing said flying disc.

2. A method of claim 1 wherein said rotating panel is free of view obstructing appendages.

3. A method of claim 1 wherein said rotating panel is free of rigid aerodynamic lift producing wing members extending from the panel in a direction orthogonal to the display plane and disposed in a cylinder defined by a perimeter of the flying disc.

4. A method of claim 2 wherein said step of causing information to be displayed includes a step of providing an LCD disposed on the rotating panel and providing a preprogrammed advertising message to be displayed on the LCD.

5. A method of claim 3 further comprising the step of attaching a streamer to said rotating panel so that an undulating motion occurs when said streamer is exposed to air in relative motion to said flying disc.

* * * * *